United States Patent [19]

Liao

[11] Patent Number: 4,777,573

[45] Date of Patent: Oct. 11, 1988

[54] MINIATURE LIGHT SET

[76] Inventor: Nan-Whair Liao, No. 18, Tzu Yu Rd., Hsin-Chu City, Taiwan

[21] Appl. No.: 153,056

[22] Filed: Feb. 8, 1988

[51] Int. Cl.[4] ..... F21V 21/00

[52] U.S. Cl. ..... 362/249; 362/806; 313/51; 439/419

[58] Field of Search ..... 362/226, 227, 234, 237, 362/238, 249, 806; 313/1, 51, 250, 251, 267, 268, 272, 285; 315/288; 439/387, 391, 414, 417, 419, 425, 492, 505, 658, 659, 699; 174/113 R, 114 R, 114 S, 117 F

[56] References Cited

U.S. PATENT DOCUMENTS 3,594,705 7/1971 Levy ..... 439/419

4,631,650 12/1986 Ahroni ..... 362/249

*Primary Examiner*—Stephen F. Husar

[57] ABSTRACT

A miniature light set applied to a series-parallel decorative light string including a miniature bulb, a bulbholder in which the bulb is mounted, and a seat. The bulbholder has a socket on the top center portion for mounting a bulb on, two conducting plates with uppermost portions inserting into the bulbholder, and a base. Three semicircular channels are disposed at the base and are complemented for forming three wire-way by other semicircular channels provided at the seat. A pair of roughly surfaced strips are provided transverse to the channels, both on the base and the seat.

3 Claims, 7 Drawing Sheets

MINIATURE LIGHT SET

BACKGROUND OF THE INVENTION

The present invention relates to a miniature light set, and more particularly relates to a miniature light set combined with a seat so as to be firmly mounted on a cord.

Various types of miniature light sets have been developed in many parts of the world for application to a series-parallel decorative light string. As disclosed in U.S. Pat. No. 4,631,650, lampholders are provided with a snap-on cover at their base end which swings into a closed position and provides a wireway with the rest of the lampholder housing. Two contact plates in each lampholder have pointed contact fingers projecting into the wireway to pierce the insulation of the cord to make the proper electrical connection to the wire. It is submitted that this patent is readable among the art of record, but not without its drawbacks. For example, firstly the prior art is not secure enough for the cover joined to the housing just by an integral hinge portion of reduced cross section. Secondly, a cord which has a series of cutouts is required in the patent; therefore, it is not convenient to make the cutouts on the cord. The prsent invention can actually obviate and/or mitigate the above-mentioned drawbacks.

SUMMARY OF THE INVENTION

A primary objective of the present invention is to provide a miniature light set which is tightly mounted on a string by combined with a seat, wherein the seat has roughly surfaced strips.

Another objective of the present invention is to provide a miniature light set which can be applied on a three-strand insulated cord, wherein the middle wire of the cord is cut for mounting a bulbholder.

Still another objective of the present invention is to provide a miniature light set which has performance characteristics superior to any heretofore available.

Another objective of the present invention is to provide a miniature light set which is applied to a series-parallel decorative light string.

Further objectives and advantages of the present invention will become apparent as the following description proceeds, and the features of novelty which characterize the invention will be pointed out with particularity in the claims annexed to and forming a part of this invention.

DETAILED DESCRIPTION OF THE PREFERRED EMBODIMENT

Figure 1:
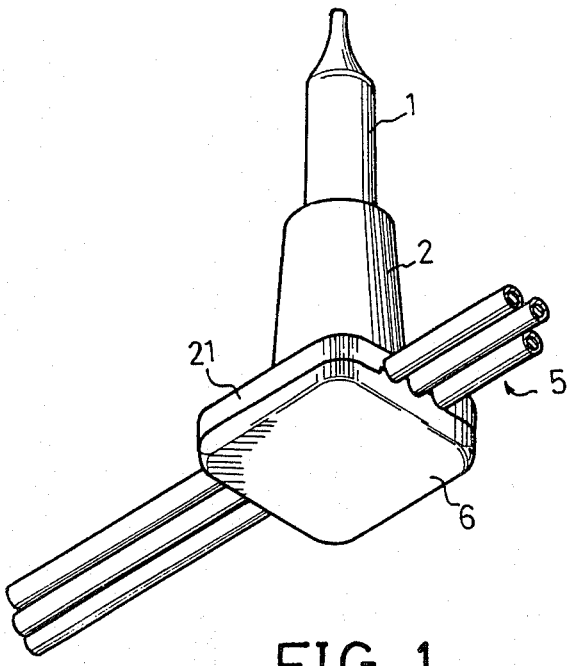
FIG. 1 is a perspective view of a miniature light set in accordance with the present invention.
Figure 3:
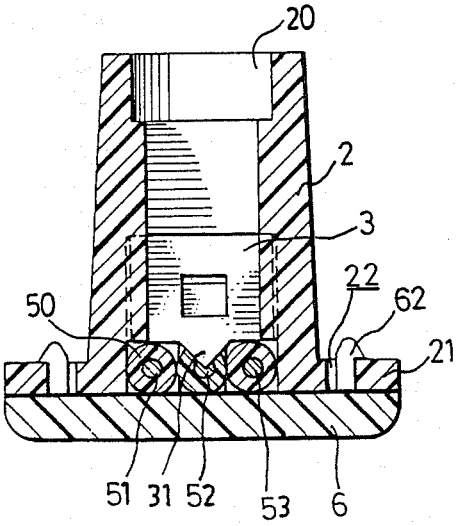
FIG. 3 is a cross-sectional view of the miniature light set of FIG. 1, showing a conducting plate with a center tapered sharp edge.
Figure 2:
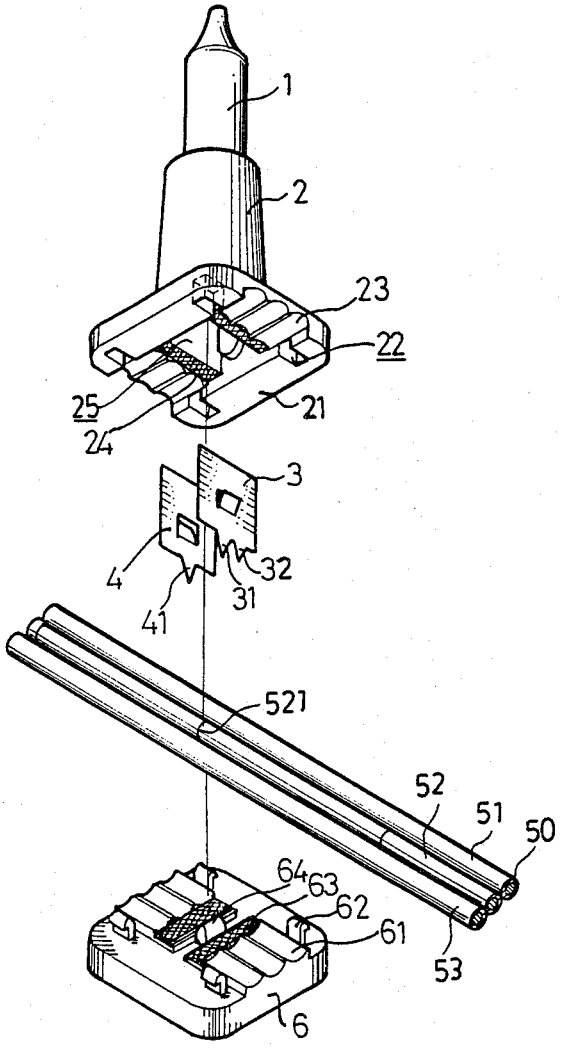
FIG. 2 is an exploded view of the miniature light set of FIG. 1.

With reference to the drawings and particular to FIGS. 1 to 3 thereof, it can be seen that a light set in accordance with the present invention comprises a miniature bulb 1, a bulbholder 2 in which the bulb 1 is mounted, and a seat 6. The bulbholder 2 has a socket 20 on the top center portion thereof for mounting the bulb 1, two conducting plates 3, 4 which insert into the bore 25 of the bulbholder 2, and a base 21.

A slot 22 is provided on each corner of the base 21. Three first semicircular channels 23 are disposed longitudinally along a central portion of the base 21. The three first semicircular channels 23 are complemented by another three second semicircular channels 61 provided at the seat 6. A pair of roughly surfaced strips 24, 63 are provided transverse to the channels 23 and 61, respectively on the base 21 and the seat 6. The roughly surfaced strips 24, 63 are higher than the lowest portion of the first and second semicircular channels 23, 61. A hook 62 is provided on each corner of the seat 6 to ride over the slot 22, so that the base 21 and the seat 6 lock together tightly. A pointed arch-shaped protuberance 64 is disposed between the roughly surfaced strips 63 on the seat 6.

A three-strand insulated cord 5 is applied in this embodiment of the present invention, as shown in FIG. 2, wherein the middle wire 52 of the insulated cord 5 is cut at a plurality of positions 521 for mounting a light set. After the hook 62 rides over the slot 22, the channels 23 and 61 collectively form a three-sectioned wire-way for receiving the insulated cord 5. The pointed arch-shaped protuberance 64 urges tightly the middle wire 52 to break and separate at the cut positions 521; furthermore, the roughly surfaced strips 24 and 63 prevent the insulated cord 5 from slipping away while the middle wire 52 is urged by the pointed arch-shaped protuberance 64.

In large part, the bulb 1, bulbholder 2, and two conducting plates 3, 4 as thus far described are similar to those shown in U.S. Pat. No. 4,631,650.

Figure 5:
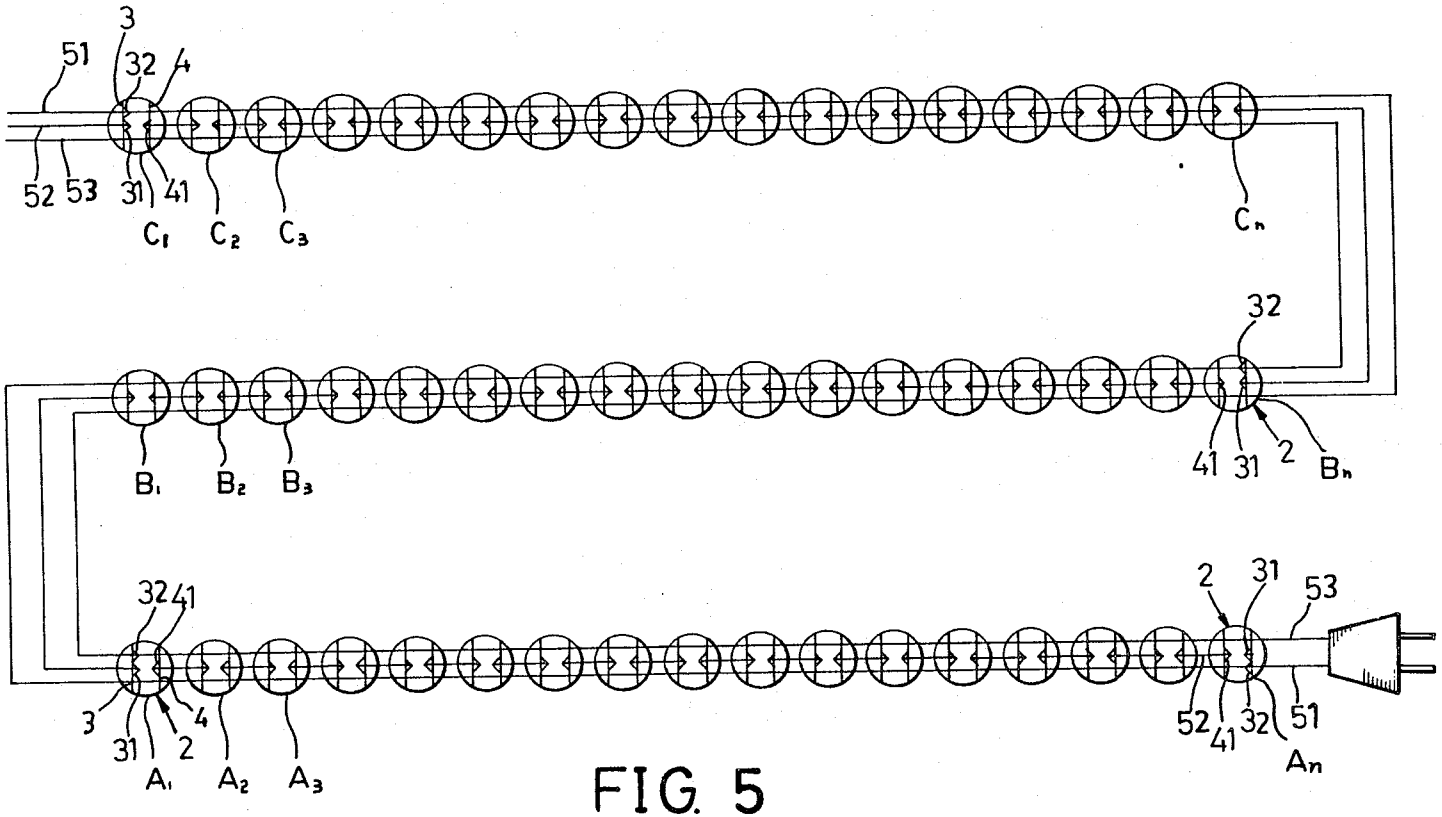
FIG. 5 is a schematic view in accordance with the present invention showing the conjunctions of all the tapered sharp edges on each light set and the cord in series-parallel connection.

To assemble a lighting string as shown in FIG. 5, the circles indicate the bulbholder 2, and the arrows indicate the conjunctions of the tapered sharp edges and the wires. It can be seen that the cord 5 consists of a three series set (An, Bn and Cn), which is in parallel connection. Each series set is formed by a plurality of bulbholders indicated at a1, a2, . . . an, b1, b2, . . . bn, and c1, c2, . . . cn.

The inner and outer conducting plates 3, 4 of the intermediate bulbholder 2 in each series set An, Bn, or Cn only have a center tapered sharp edges 31, or piercing through a coating 50 of the middle wire 52, as shown in FIG. 3.

Figure 4:
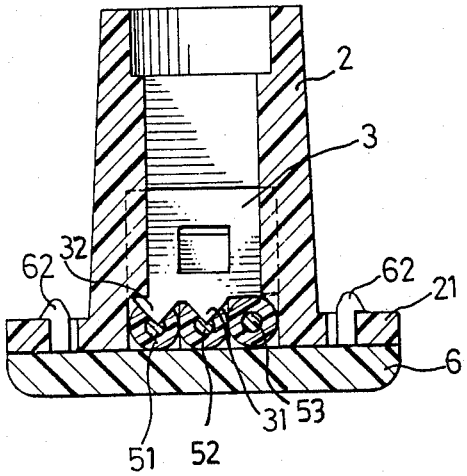
FIG. 4 is another cross-sectional view, similar to FIG. 3, but showing a conducting plate with two tapered sharp edges.

The outer conducting plate 3 of the first bulbholder 2 of each series set has a center tapered sharp edge 31 piercing through the coating 50 of the middle wire 52 and also has an outer tapered sharp edge 32 contacting an outer wire 51, as shown in FIG. 4. Furthermore, the inner conducting plate 4 of the first bulbholder 2 has a center tapered sharp edge 41 thereon piercing through the coating 50 of the middle wire 52.

Similarly, the outer conducting plate 3 of the last bulbholder 2 of each series set has a center tapered sharp edge 31 thereon piercing through the coating 50 of the middle wire 52 and an outer tapered sharp edge 32 piercing through the coating 50 of another outer wire 53. Also, the inner conducting plate 4 of the last bulbholder 2 has a center tapered sharp edge 41 piercing through the coating 50 of the middle wire 52.

Figure 6:
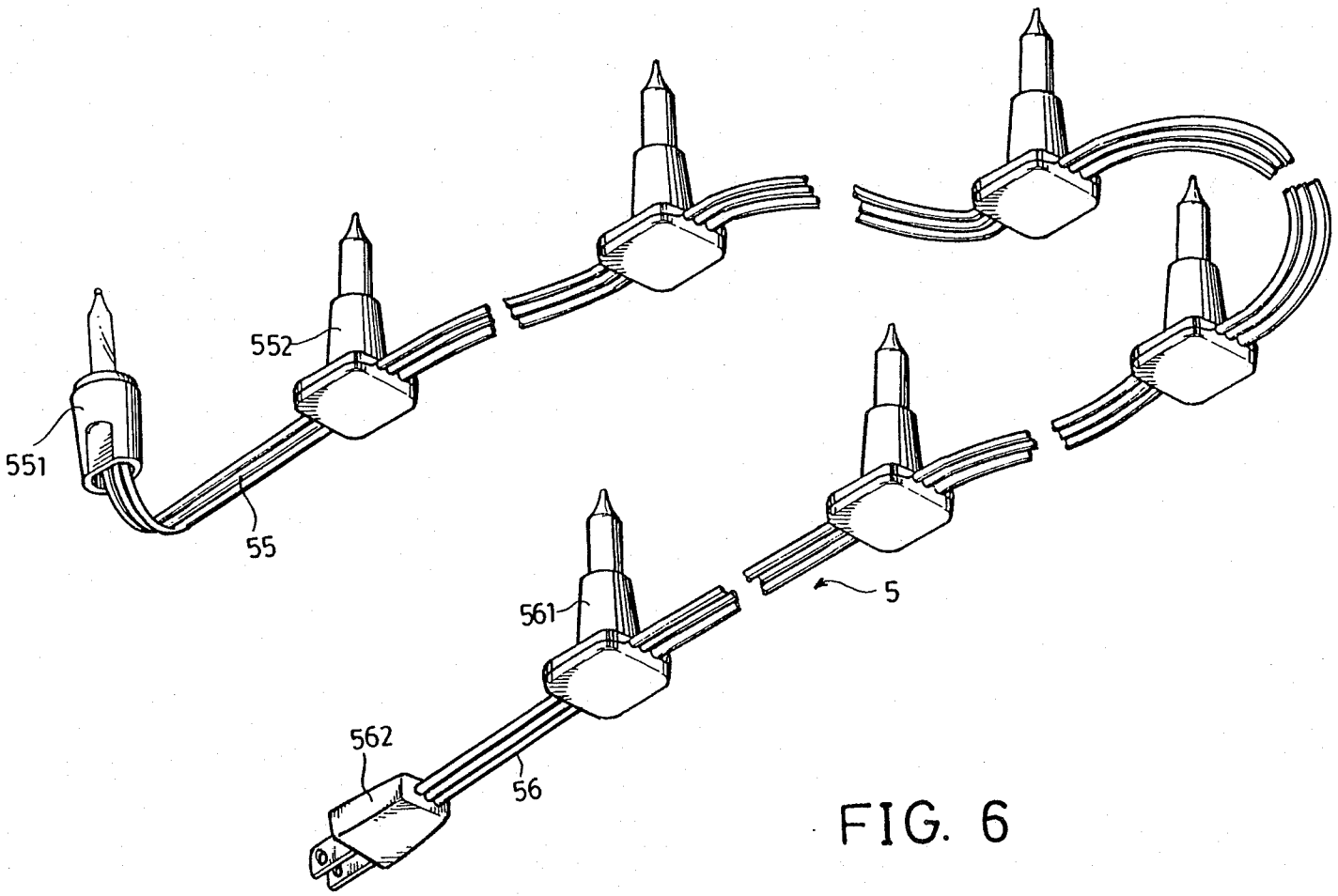
FIG. 6 is a perspective view of a series of miniature lights in accordance with the present invention.
Figure 7:
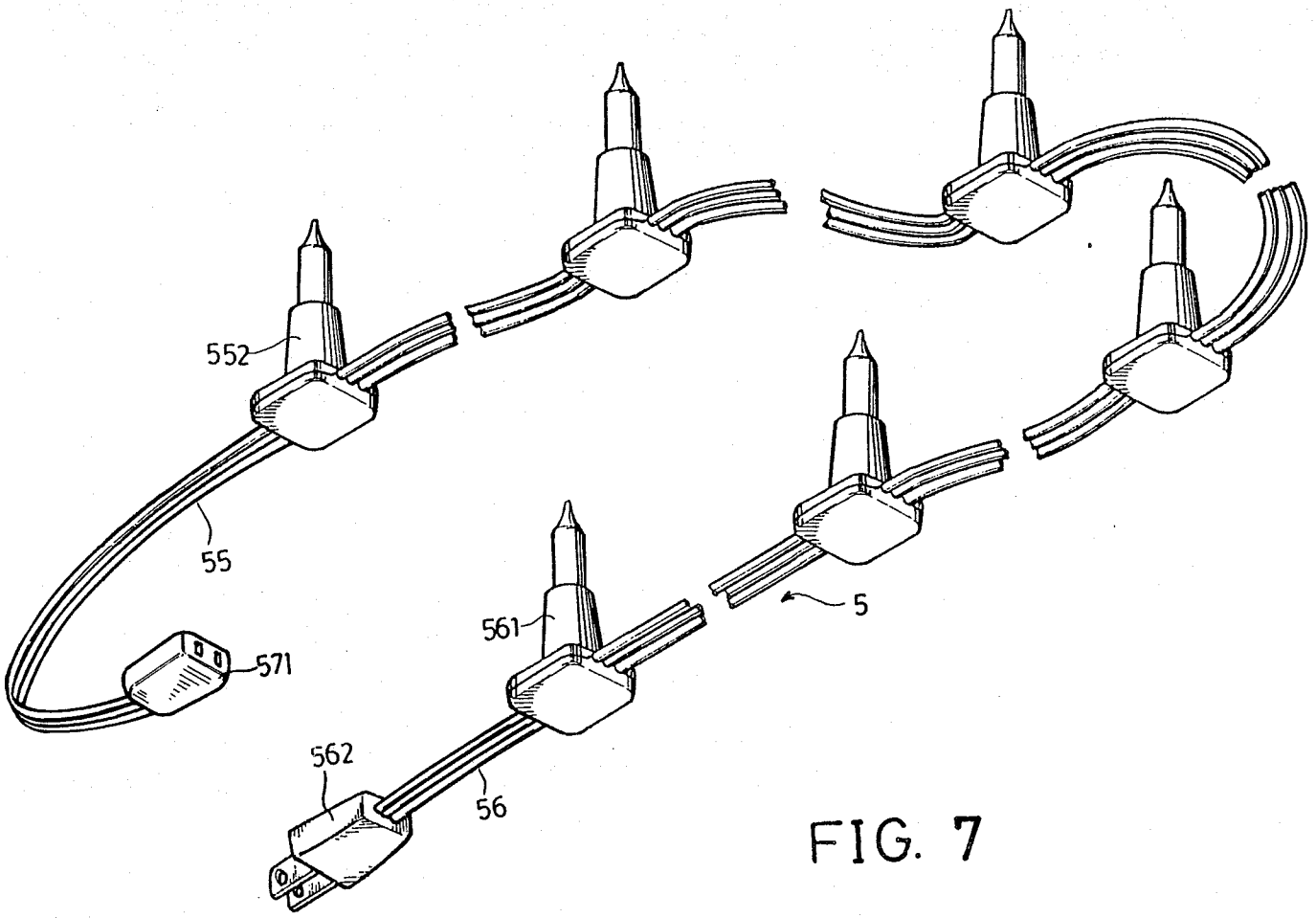
FIG. 7 is a working view similar to FIG. 6, but illustrating that a series of miniature lights with a socket at one end thereof.

Referring to FIG. 6, it can be seen that at one terminal of the cord 5 mounted on several of above-mentioned series sets, a bulbholder 551 is connected to next bulbholder 552 with three-strand insulated cord 55. Moreover, the bulbholder 551 can be replaced by a socket 571, as shown in FIG. 7, for connecting another series set. At the opposite terminal of the cord 5, a bulbholder 561 is connected to a plug 562 with three-strand insulated cord 56.

Figure 8:
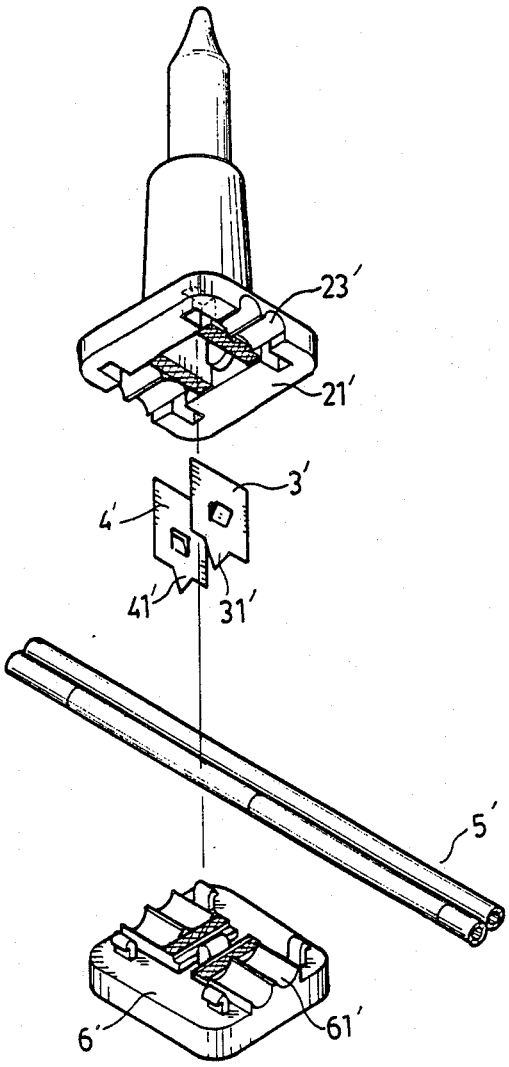
FIG. 8 is another exploded view of the miniature light set, similar to FIG. 2, but illustrating the miniature light set applied to a two-strand insulated cord.

Further referring to a second embodiment shown in FIG. 8, it can be seen that the miniature light set is applied to a two-strand insulated cord 5', wherein the miniature light set is in series connection. In this situation, two first and second semicircular channels 23', 61' are respectively disposed longitudinally along central portions of the base 21' and the seat 6'. Conducting plates 3', 4' have only one tapered sharp edges 31', 41', respectively. It is appreciated that the present invention is applied to either a two or a three-strand insulated cord.

While the invention has been explained in relation to its preferred embodiments, it is to be understood that various modifications thereof will become apparent to those skilled in the art upon reading this specification. Therefore, it is to be understood that the invention disclosed herein is intended to cover such modifications as fall within the scope of the appended claims.

I claim:

1. A miniature light set applied to a series-parallel decorative light string comprising a miniature bulb (1), a bulbholder (2) wherein said bulb (1) is mounted, and a seat (6); said bulbholder (2) having a socket (20) on a top center portion for mounting said bulb (1), two conducting plates (3, 4) inserting into said bulbholder (2), and a base (21); the improvement comprising:

(a) a slot (22) provided on each corner of said base (21);

(b) three first semicircular channels (23) disposed longitudinally along a central portion of said base (21);

(c) a pair of roughly surfaced strips (24) being provided transverse to said first semicircular channels (23) for preventing an insulated cord (5) from slipping away;

(d) a hook (62) provided on each corner of said seat (6) to ride over said slot (22) for combining said base (21) and said seat (6) together;

(e) three second semicircular channels (61) disposed longitudinally along a central portion of said seat (6) and complemented by said three first semicircular channels (23) for forming a three-sectioned wireway;

(f) a pair of roughly surfaced strips (63) provided transverse to said second semicircular channels (61) for preventing said insulated cord (5) from slipping away;

(g) a protuberance (64) disposed between said roughly surfaced strips (63) on said seat (6) for urging a cut middle wire (52) of said insulated cord (5) to separate and break at a cut position (521).

2. A miniature light set according to claim 1, wherein said conducting plate (3) is provided within said bulbholder (2) and said conducting plate (3) has a center tapered sharp edge (31) piercing through a coating (50) of said middle wire (52).

3. A miniature light set according to claim 1, wherein said conducting plate (3) is provided within said bulbholder (2) and said conducting plate (3) has two tapered sharp edges (31, 32) piercing through said coating (50) of said cord (5).

* * * * *